US007040393B2

(12) United States Patent
Adams et al.

(10) Patent No.: US 7,040,393 B2
(45) Date of Patent: May 9, 2006

(54) CHOKE AND KILL LINE SYSTEMS FOR BLOWOUT PREVENTERS

(75) Inventors: James M. Adams, Cypress, TX (US); Jason P. Curtiss, III, Houston, TX (US)

(73) Assignee: Control Flow Inc., Houston, TX (US)

( * ) Notice: Subject to any disclaimer, the term of this patent is extended or adjusted under 35 U.S.C. 154(b) by 204 days.

(21) Appl. No.: 10/601,946

(22) Filed: Jun. 23, 2003

(65) Prior Publication Data

US 2004/0256107 A1 Dec. 23, 2004

(51) Int. Cl.
*E21B 23/02* (2006.01)

(52) U.S. Cl. ..... 166/77.51; 166/85.4; 166/85.5; 285/401; 285/391

(58) Field of Classification Search ..... 166/77.51, 166/85.4, 85.5, 338, 344, 345, 368, 363; 285/124.4, 124.5, 360, 378, 401, 391
See application file for complete search history.

(56) References Cited

U.S. PATENT DOCUMENTS 3,688,840 A * 9/1972 Curington et al. ..... 166/341
3,877,520 A 4/1975 Putnam
3,974,875 A * 8/1976 Herd et al. ..... 166/367
4,053,023 A 10/1977 Herd et al.
4,210,208 A 7/1980 Shanks
4,319,637 A * 3/1982 Wilson ..... 166/340
4,488,740 A 12/1984 Baugh et al.
4,540,053 A 9/1985 Baugh et al.
4,597,448 A 7/1986 Baugh
4,615,544 A 10/1986 Baugh
4,618,314 A 10/1986 Hailey
4,668,126 A 5/1987 Burton
4,807,705 A 2/1989 Henderson et al.
4,848,472 A 7/1989 Hopper (Continued)

OTHER PUBLICATIONS

RetroSearch Search Results with Abstracts, Mar. 24, 2003, pp. 1-8.

*Primary Examiner*—Jennifer H. Gay
*Assistant Examiner*—Matthew J. Smith
(74) *Attorney, Agent, or Firm*—Andrews Kurth LLP; Anthony F. Matheny

(57) ABSTRACT

The invention is directed to pressure lines for use with equipment associated with drilling and production risers, and in particular, pressure lines having breechblock connections with the equipment and with choke and kill lines for use in connection with different sized blowout preventer stacks ("BOP stacks"). The pressure line systems and choke and kill line systems of the invention include a breechblock connection for quick and easy removal and installation of the pressure lines to riser equipment and the choke and kill lines to BOP stacks. Additionally, the choke and kill lines of the invention may include a coupling system having a BOP connector, or plate assembly, for permitting one set of choke and kill lines to be used on various sized BOP stacks. The plate assembly is in fluid communication with a first choke or kill line connector. Each of the choke and kill lines, or hoses, include a second choke or kill line connector, preferably as part of a line assembly, which is capable of being releaseably secured to the first choke or kill line connector. Therefore, by installing a plate assembly on different sized BOP stacks, one set of choke and kill lines can be used in connection with multiple sized BOP stacks. Methods of replacing BOP stacks and installing and removing choke and kill lines and pressure lines are also disclosed.

26 Claims, 5 Drawing Sheets

U.S. PATENT DOCUMENTS

| | | | |
|---|---|---|---|
| 4,863,314 | A | 9/1989 | Baugh |
| 5,634,671 | A | 6/1997 | Watkins |
| 6,009,950 | A | 1/2000 | Cunningham et al. |
| 6,032,742 | A | 3/2000 | Tomlin et al. |
| 6,059,042 | A | 5/2000 | Huber et al. |
| 6,089,321 | A | 7/2000 | Morrill |
| 6,470,975 | B1 | 10/2002 | Bourgoyne et al. |
| 6,530,430 | B1 * | 3/2003 | Reynolds ..... 166/346 |
| 2003/0024705 | A1 | 2/2003 | Whitby et al. |
| 2003/0136927 | A1 | 7/2003 | Baugh |

* cited by examiner

CHOKE AND KILL LINE SYSTEMS FOR BLOWOUT PREVENTERS

BACKGROUND OF THE INVENTION

1. Field of the Invention

The invention relates to pressure lines for use with equipment associated with drilling and production risers, and in particular, pressure lines having breechblock connections with the equipment and choke and kill lines for use in connection with different sized blowout preventer stacks ("BOP stacks").

2. Description of Related Art

Various pieces of equipment associated with drilling and production risers are well known in the art. It also is well known in the art that many of these pieces of equipment require pressure conduits, or pressure lines, to supply pressure through the lumen of the pressure lines to the equipment in order for the equipment to control and operate valves and other mechanical components of the equipment. These pressure activated pieces of equipment are referred to herein as "riser equipment." Examples of riser equipment include tensioners, slip-joint assemblies, and slip-joint tensioner assemblies. Generally, the pressure lines used in connection with riser equipment are pneumatic or hydraulic; however, in some instances, such as in choke and kill lines, the source of the pressure in the pressure lines is created by drilling mud or other drilling fluids.

Due to the high pressures normally associated with the pressure lines, the connection of the pressure lines to the riser equipment is important. Currently, the connections between the pressure lines and the riser equipment include threaded connections, use of clamps, use of locking mechanisms such as pins, lug locks, or set screws, use of latch-dogs, and use of bolted flanges. However, all of these require large amounts of time and manpower to install and remove the pressure lines resulting in well downtime. Therefore, it is desired in the art to have pressure lines for riser equipment to permit quick and easy installation and removal of the pressure lines.

Choke and kill lines for use with BOP stacks also are well known in the art. In general, each BOP stack includes at least one choke line and one kill line. Each of the choke lines and the kill lines are releaseably connected to the BOP stack and a pressure source, e.g., hydraulic source, which are capable of providing pressure through the choke and kill lines to control the wellbore and BOP stack during drilling of oil and gas wells, etc.

In current practice, choke and kill lines are present on the BOP stack for oil or gas drilling. In some cases, one set of choke and kill lines may be used for one size and pressure rated BOP stack and a second set of choke and kill lines for another size and pressure rated BOP stack. For example, one set of choke and kill lines may be capable of withstanding 1,000 psi. Therefore, in the event that the pressure at the wellhead increases above 1,000 psi, the choke and kill lines will not function and may rupture causing damage and possible injury. Accordingly, in such a situation, a second set of choke and kill lines having a tolerance for higher pressures, e.g., greater than 1,000 psi, must be installed on the BOP stack.

Moreover, a second, larger, BOP stack may also be required to address the high pressures on the wellhead or to accommodate the various volumes of oil or gas flowing through the BOP stack. However, in current embodiments, the connector assembly between the BOP stack and each of the choke and kill lines can be different on the different sized BOP stacks. For example, a 21¼" BOP stack can have a smaller connection assembly for the choke and kill lines than a 13⅝" BOP stack.

Therefore, it is desired in the art to have a coupling system, or choke and kill line system, between each of the choke and kill lines and the BOP stack that is capable of withstanding high pressures and also provides quick and easy removal and installation, thereby reducing the amount of time that the well equipment is being readied for or is out of service. It is also desired in the art to have a coupling system, or choke and kill line system, between each of the choke and kill lines that permits each of the choke and kill lines to be connected to different sized BOP stacks universally.

Another concern of current coupling systems, and choke and kill line systems and other large line hydraulic or air control systems, is the amount of weight that the connections between the choke and kill lines and the BOP stack must sustain or the other pressure control systems must sustain. This concern increases as the size of the choke and kill lines or other pressure lines increase. Therefore, it is desired in the art to have a coupling system, or choke and kill line system, or other pressure line system, that assists in relieving some, if not all, of the weight forces of the choke and kill lines on the connections between the choke and kill lines and the BOP stack or on connections between pressure lines and other equipment.

As mentioned above, the present inventions address the foregoing concerns. Specifically, in one aspect of the present invention, the coupling system and choke and kill line systems, of the present invention include lines that can withstand the maximum amount of pressure envisioned on a particular wellhead or riser system and that can be used on various sized BOP stacks. This aspect of the present invention, therefore, provides a fast and efficient means of changing the choke and kill lines from one BOP stack, or other equipment, to another BOP stack or other equipment, by utilizing a connection designed specifically for this purpose. Accordingly, cost savings are realized with the connection of the choke and kill lines to the BOP stacks, or other lines to other equipment, requiring less time and manpower to accomplish.

Additionally, in another aspect of the invention, the pressure lines for riser equipment, coupling systems, and choke and kill line systems, of the present invention include a breechblock connection such that the pressure lines or choke and kill lines can be easily and quickly removed from one piece of riser equipment, or BOP stack, and installed on a second piece of riser equipment, or BOP stack. Therefore, time savings are realized and less manpower is required to change from one piece of riser equipment or BOP stack to another piece of riser equipment or BOP stack.

Further, in another aspect of the invention, the coupling systems, and choke and kill line systems, of the present invention include one or more guide assemblies that can be secured to the BOP stack, or other support structure, e.g., the platform or riser superstructure, to alleviate some of the weight caused by the choke and kill lines on the connections of the choke and kill lines with the BOP stack.

Accordingly, prior to the development of the present invention, there has been no pressure line system, choke or kill line system, or coupling system, which: provide quick and efficient connection of each of the pressure lines with the riser equipment; reduce the amount of manpower needed to remove and install the pressure lines on the riser equipment; provide quick and efficient connection of each of the choke and kill lines with the BOP stack or other pressure lines to other riser equipment; and reduce the amount of manpower needed to remove and install the choke and kill lines on the BOP stack or other pressure lines to other riser equipment. Therefore, the art has sought a pressure line system, a choke or kill line system, and a coupling system, which: provide quick and efficient connection of each of the pressure lines with the riser equipment; reduce the amount of manpower needed to remove and install the pressure lines on the riser equipment; provide quick and efficient connection of each of the choke and kill lines with the BOP stack or other pressure lines to other riser equipment; and reduce the amount of manpower needed to remove and install the choke and kill lines on the BOP stack or other pressure lines to other riser equipment.

SUMMARY OF INVENTION

In accordance with the invention the foregoing advantages have been achieved through the present choke and kill line system for at least two different sized blowout preventers comprising: a choke line having a choke line coupling member for connecting the choke line to each of the at least two different sized blowout preventers; a kill line having a kill line coupling member for connecting the kill line to each of the at least two different sized blowout preventers; a first blowout preventer coupling member secured to each of the at least two different sized blowout preventers, the first blowout preventer coupling member being adapted for releaseably connecting the first blowout preventer coupling member to the choke line coupling member, and the choke line coupling member being adapted for releaseably connecting the choke line coupling member to the first blowout preventer coupling member; and a second blowout preventer coupling member secured to each of the at least two different sized blowout preventers, the second blowout preventer coupling member being adapted for releaseably connecting the second blowout preventer coupling member to the kill line coupling member, and the kill line coupling member being adapted for releaseably connecting the kill line coupling member to the second blowout preventer coupling member, wherein each of the at least two different sized blowout preventers includes the first and second blowout preventer coupling members, thereby facilitating the choke and kill lines to be releaseably connected to each of the different sized blowout preventers.

A further feature of the choke and kill line system is that the choke line coupling member and the first blowout preventer coupling member may be releaseably connected to form a breechblock connection; and the kill line coupling member and the second blowout preventer coupling member may be releaseably connected to form a breechblock connection. Another feature of the choke and kill line system is that the choke line coupling member may be a male coupling member and the first blowout preventer coupling member may be a female coupling member; and the kill line coupling member may be a male coupling member and the second blowout preventer coupling member may be a female coupling member. An additional feature of the choke and kill line system is that the choke line coupling member may be a female coupling member and the first blowout preventer coupling member may be a male coupling member; and the kill line coupling member may be a female coupling member and the second blowout preventer coupling member may be a male coupling member. Still another feature of the choke and kill line system is that the choke line coupling member may be a male coupling member and the first blowout preventer coupling member may be a female coupling member; and the kill line coupling member may be a female coupling member and the second blowout preventer coupling member may be a male coupling member. A further feature of the choke and kill line system is that the choke line coupling member may be a female coupling member and the first blowout preventer coupling member may be a male coupling member; and the kill line coupling member may be a male coupling member and the second blowout preventer coupling member may be a female coupling member.

In accordance with the invention the foregoing advantages also have been achieved through the present choke and kill line system for a blowout preventer comprising: at least one choke line coupling member, at least one of the at least one choke line coupling members having first and second choke line ends, the first choke line end being adapted to be releaseably connected to a choke line and the second choke line end being adapted to be in fluid communication with the blowout preventer; and at least one kill line coupling member, at least one of the at least one kill line coupling members having first and second kill line ends, the first kill line end being adapted to be releaseably connected to a kill line and the second kill line end being adapted to be in fluid communication with the blowout preventer, wherein the first choke line end is adapted to form a breechblock connection with the choke line and the first kill line end is adapted to form a breechblock connection with the kill line.

In accordance with the invention the foregoing advantages also have been achieved through the present coupling system for releaseably connecting a line to a blowout preventer comprising: a plate having a plate guide member, a first line coupling member, and a blowout preventer connector member in fluid communication with the first line coupling member and in fluid communication with the blowout preventer; and a line assembly having a line, a line assembly guide member, and a second line coupling member, wherein the first line coupling member and the second line coupling member are each adapted to be releaseably connected with each other.

A further feature of the coupling system for releaseably connecting a line to a blowout preventer is that the first line coupling member may be a female coupling member and the second line coupling member may be a male coupling member. Another feature of the coupling system for releaseably connecting a line to a blowout preventer is that the first line coupling member may be a male coupling member and the second line coupling member may be a female coupling member. An additional feature of the coupling system for releaseably connecting a line to a blowout preventer is that the line assembly guide member may include at least one flange and the plate guide member may include at least one groove adapted for receiving the at least one flange. Still another feature of the coupling system for releaseably connecting a line to a blowout preventer is that the plate guide member may include at least one flange and the line assembly guide member may include at least one groove adapted for receiving the at least one flange. A further feature of the coupling system for releaseably connecting a line to a blowout preventer is that the first line coupling member and the second line coupling member may be adapted to be releaseably connected to form a breechblock connection. Another feature of the coupling system for releaseably connecting a line to a blowout preventer is that the plate, the first line coupling member, and the blowout preventer connector member may be formed integrally with each other.

In accordance with the invention the foregoing advantages also have been achieved through the present coupling system for releaseably connecting a choke line and a kill line to each of at least two different sized blowout preventers, the coupling system comprising: a choke line coupling member, the choke line coupling member having first and second choke line ends, the first choke line end being adapted to be releaseably connected to a choke line and the second choke line end being adapted to be in fluid communication with each of the at least two different sized blowout preventers; and a kill line coupling member, the kill line coupling member having first and second kill line ends, the first kill line end being adapted to be releaseably connected to a kill line and the second kill line end being adapted to be in fluid communication with each of the at least two different sized blowout preventers.

A further feature of the coupling system for releaseably connecting a choke line and a kill line to each of at least two different sized blowout preventers is that the first choke line end may be adapted to form a breechblock connection with the choke line and the first kill line end may be adapted to form a breechblock connection with the kill line. Another feature of the coupling system for releaseably connecting a choke line and a kill line to each of at least two different sized blowout preventers is that the first choke line end may be a male coupling member and the first kill line end may be a male coupling member. An additional feature of the coupling system for releaseably connecting a choke line and a kill line to each of at least two different sized blowout preventers is that the first choke line end may be a female coupling member and the first kill line end may be a female coupling member. Still another feature of the coupling system for releaseably connecting a choke line and a kill line to each of at least two different sized blowout preventers is that the first choke line end may be a female coupling member and the first kill line end may be a male coupling member. A further feature of the coupling system for releaseably connecting a choke line and a kill line to each of at least two different sized blowout preventers is that the first choke line end may be a male coupling member and the first kill line end may be a female coupling member.

In accordance with the invention the foregoing advantages also have been achieved through the present pressure line system for riser equipment comprising: at least one pressure line coupling member, at least one of the at least one pressure line coupling members having first and second pressure line ends, the first pressure line end being adapted to be releaseably connected to a pressure line and the second pressure line end being adapted to be in fluid communication with the riser equipment, wherein the first pressure line end is adapted to form a breechblock connection with the pressure line.

A further feature of the pressure line system for riser equipment is that the riser equipment may be a tensioner, a slip-joint assembly, or a slip-joint tensioner assembly.

In accordance with the invention the foregoing advantages also have been achieved through the present pressure line system for riser equipment comprising: a pressure line having a first pressure line end and a second pressure line end, the first pressure line end having a first breechblock coupling member and the second pressure end being adapted to be in fluid communication with a pressure source; and a second breechblock coupling member in fluid communication with the riser equipment, wherein, the first breechblock coupling member is releaseably connected to the second breechblock coupling member to form a breechblock connection between the pressure line and the riser equipment.

A further feature of the pressure line system for riser equipment is that the riser equipment may be a tensioner, a slip-joint assembly, or a slip-joint tensioner assembly. Another feature of the pressure line system for riser equipment is that the first breechblock coupling member may be a male breechblock coupling member and the second breechblock coupling member may be a female breechblock coupling member. An additional feature of the pressure line system for riser equipment is that the first breechblock coupling member may be a female breechblock coupling member and the second breechblock coupling member may be a male breechblock coupling member. Still another feature of the pressure line system for riser equipment is that the pressure line may include a diameter greater than two inches. A further feature of the pressure line system for riser equipment is that the pressure line may be capable of withstanding pressures in the range from 100 psi to 20,000 psi.

The pressure line systems, choke or kill line systems, and coupling system of the invention, when compared with previously proposed pressure line systems, choke or kill line systems, or coupling systems, have the advantages of: providing quick and efficient connection of each of the pressure lines with the riser equipment; reducing the amount of manpower needed to remove and install the pressure lines on the riser equipment; providing quick and efficient connection of each of the choke and kill lines with the BOP stack or other pressure lines to other riser equipment; and reducing the amount of manpower needed to remove and install the choke and kill lines on the BOP stack or other pressure lines to other riser equipment.

While the invention will be described in connection with the preferred embodiment, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION AND SPECIFIC EMBODIMENTS

Broadly, in one aspect, the present invention is directed to the use of breechblock connections between various pressure lines for use with equipment associated with drilling and production risers. In one specific embodiment, the pressure lines are choke and kill lines for use with BOP stacks. In another specific embodiment, the pressure lines are utilized with various riser equipment, such as tensioners, slip-joint assemblies, and slip-joint tensioner assemblies. The use of the breechblock connections permit quick and easy installation and removal of the pressure lines from the BOP stacks and the riser equipment.

In another aspect, the invention is directed to a coupling system for use on or in connection with BOP stacks to permit quick and easy installation and removal of pressure lines from the BOP stacks.

In all of the embodiments, the pressure in each of the pressure lines may be created pneumatically, hydraulically, by drilling mud, by drilling fluid, or by any other method known to persons skilled in the art.

Figure 3:
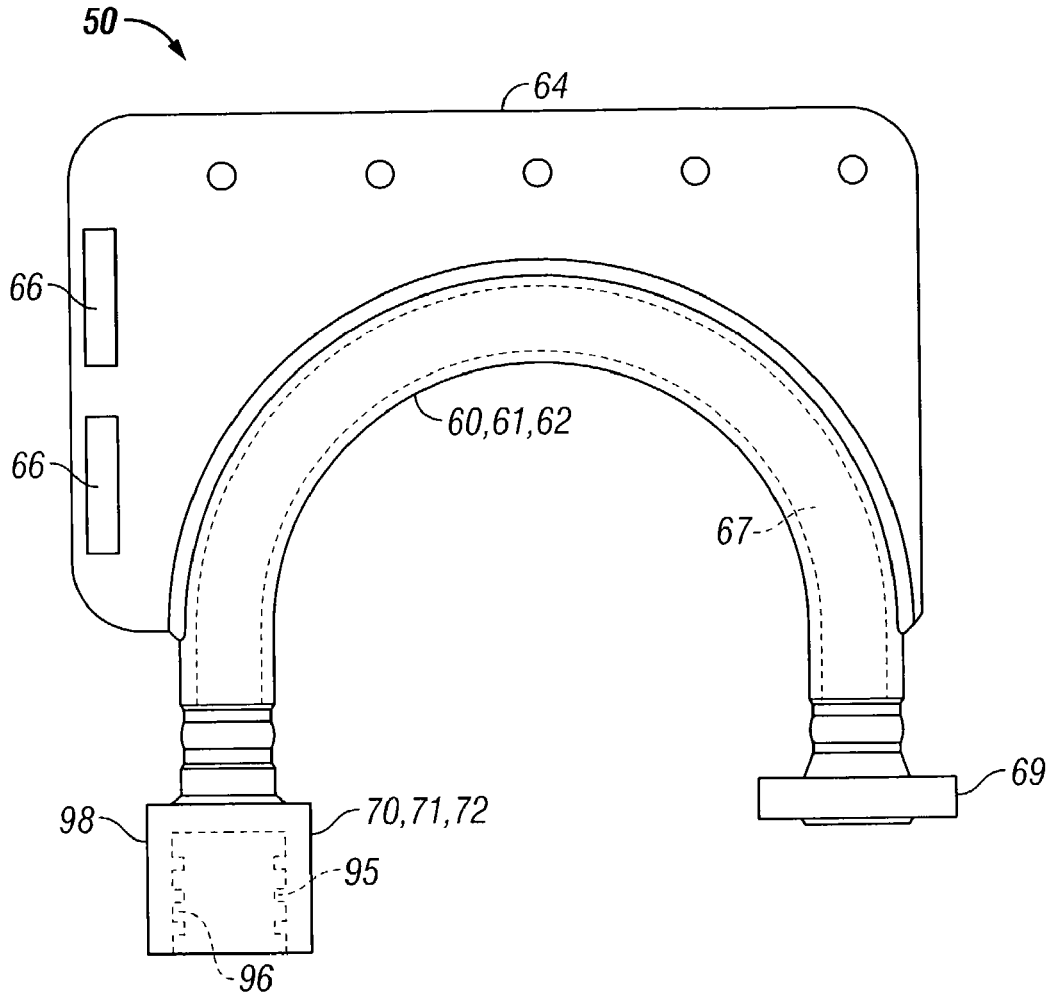
FIG. 3 is a side view of a line assembly of one specific embodiment of the present invention.
Figure 4:
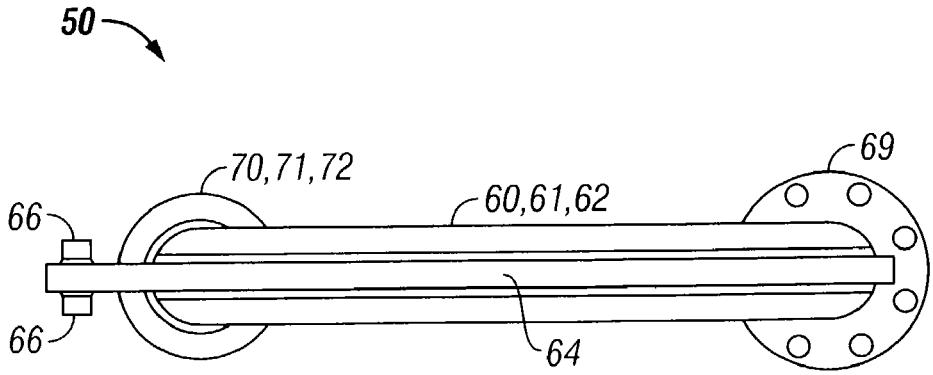
FIG. 4 is a top view of the line assembly shown in FIG. 3.
Figure 5:
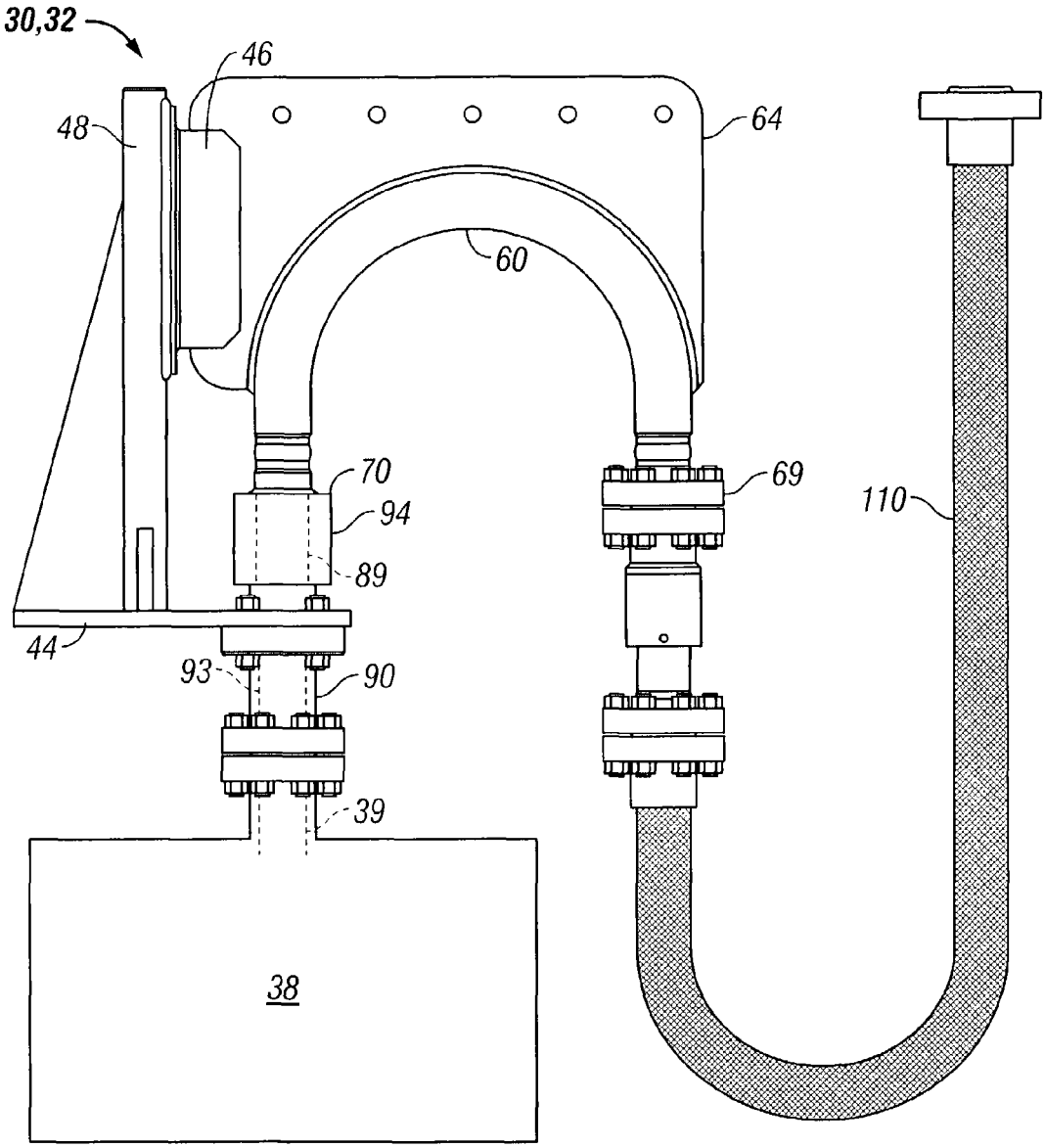
FIG. 5 is a side view of one specific embodiment of the coupling system of the present invention.
Figure 6:
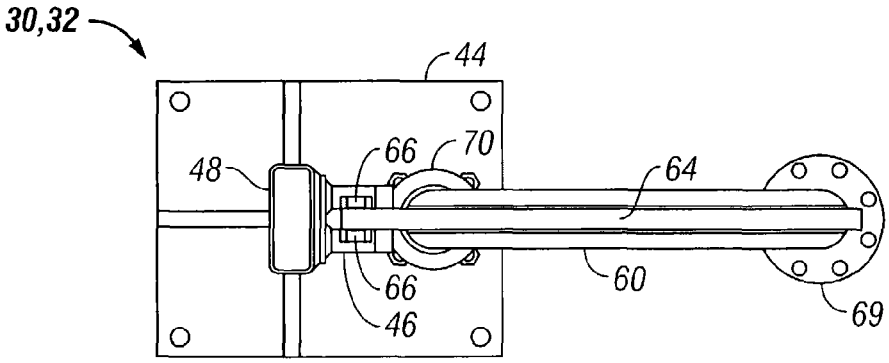
FIG. 6 is a top view of the coupling system shown in FIG. 7.

Referring now to FIGS. 1–8, in one aspect, the invention is directed to coupling system 30 which is, in this embodiment, choke and kill line system 32 for releaseably connecting line 60 to blowout preventer 38 (FIG. 5). Broadly, coupling system 30 includes plate assembly 40 and line assembly 50. Line 60 may be choke line 61 or kill line 62.

Plate assembly 40 includes plate 44, plate guide member 46 and plate guide support member 48. Plate guide member 46 includes groove 49 to facilitate the alignment of line assembly 50 with plate assembly 40 to releaseably connect line 60, choke line 61, or kill line 62 to blowout preventer 38. Alternatively, plate guide member 46 may include one or more flanges to facilitate the alignment of line assembly 50 with plate assembly 40 to releaseably connect line 60, choke line 61, or kill line 62 to blowout preventer 38. In the embodiment shown in FIGS. 1–4 and 7–8, flange 66 is adapted to be inserted into groove 49.

Figure 1:
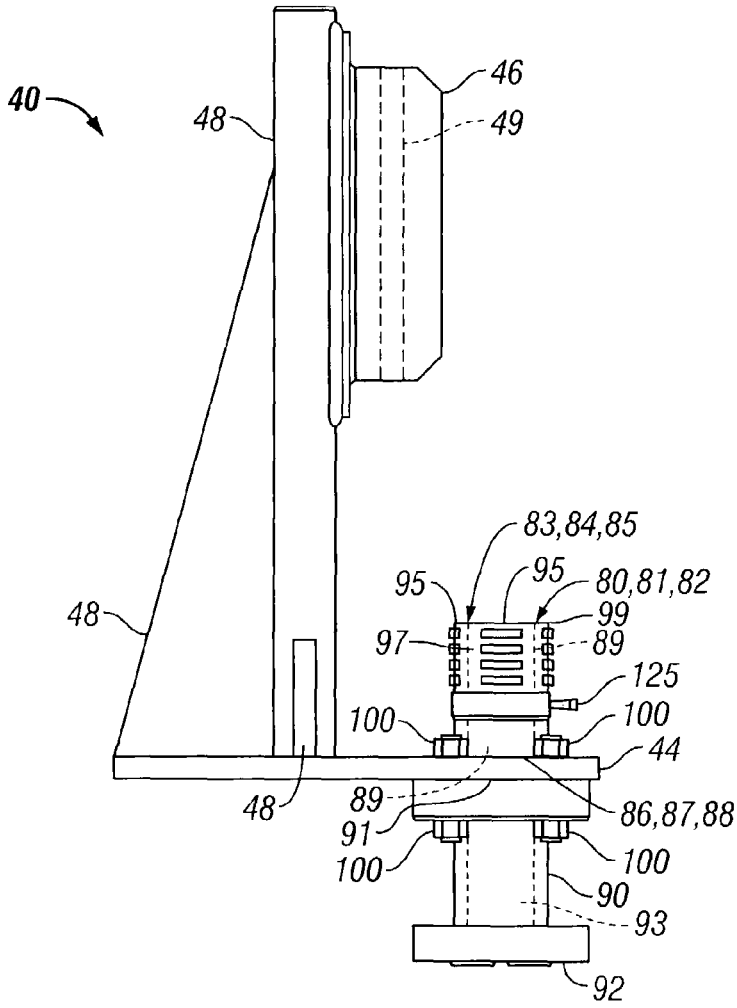
FIG. 1 is a side view of a plate assembly of one specific embodiment of the present invention.
Figure 2:
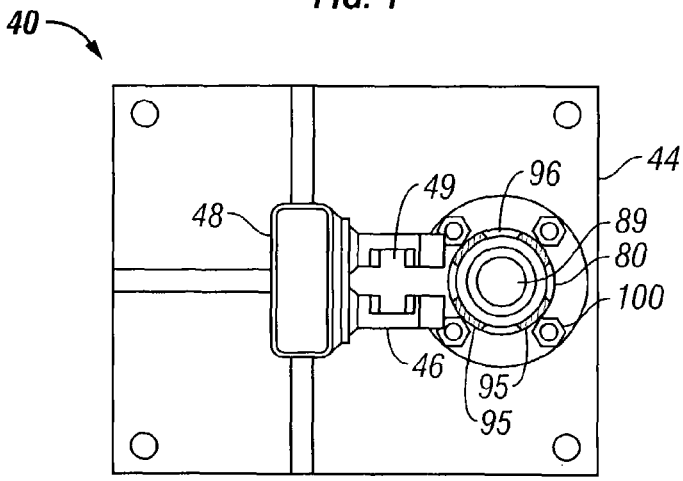
FIG. 2 is a top view of the plate assembly shown in FIG. 1.
Figure 7:
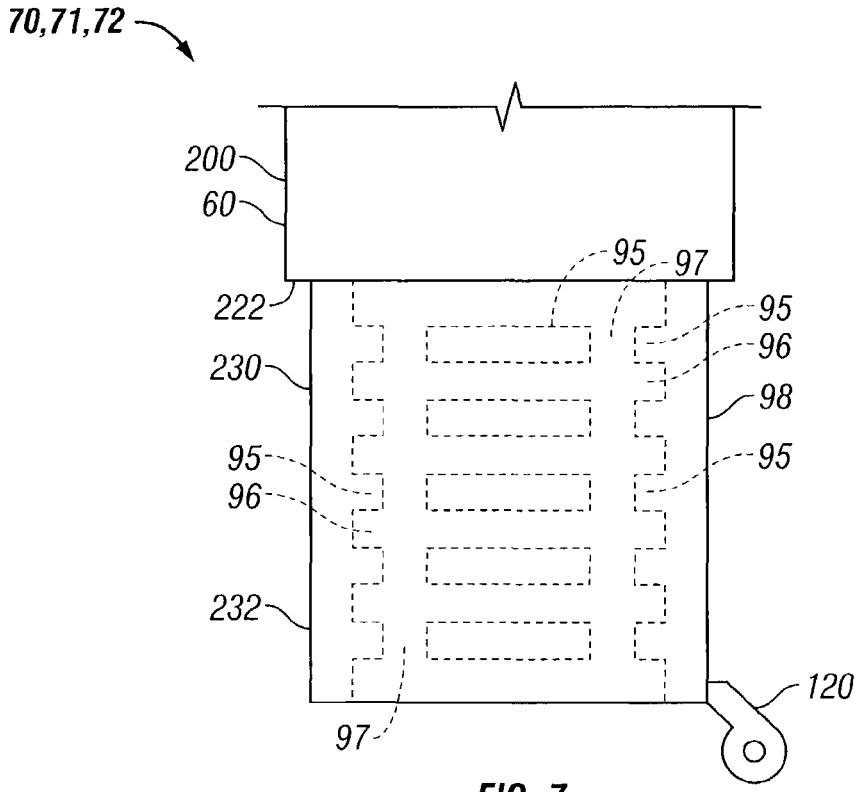
FIG. 7 is a side view of a female line coupling member of one specific embodiment of the present invention.

Plate 44 also includes line coupling member 80 having cavity or lumen 89 for permitting fluid to pass through line coupling member 80. Line coupling member 80 may be choke line coupling member 81 or kill line coupling member 82 depending on whether a choke line 61 or a kill line 62 is being releaseably connected to line coupling member 80. Line coupling member 80 includes first end 83 which may be a first choke line end 84 or a first kill line end 85. Line coupling member 80 also includes second end 86 which may be a second choke line end 87 or a second kill line end 88. Second end 86 may be secured directly to blowout preventer 38 or may be connected to blowout preventer coupling member 90 as shown in FIGS. 1 and 7 which is then secured to blowout preventer 38. Blowout preventer coupling member 90 includes cavity or lumen 93 for permitting fluid to pass through blowout preventer coupling member 90 and into blowout preventer 38 through blowout preventer passageway 39. In this specific embodiment, blowout preventer coupling member 90 is disposed along, or connected to, line coupling member 80 to facilitate securing line coupling member 80 to blowout preventer 38.

As shown in FIGS. 1 and 7, blowout preventer coupling member 90 is a separate member that is secured at first end 91 of blowout preventer coupling member 90 to plate 44 by bolts 100. Second end 92 of blowout preventer coupling member 90 is secured to blowout preventer 38.

Line coupling member 80 is secured to plate 44 by bolts 100 or other devices and methods known to persons of ordinary skill in art, e.g., welding, threaded connection, or forming line coupling member 80 integral with plate 44, such that line coupling member 80 is in fluid communication with blowout preventer coupling 90. In this embodiment, second end 86 of line coupling member 80 is secured to plate 44.

In another specific embodiment, line coupling member 80 and blowout preventer coupling 90 are formed integral with plate 44 such that bolts 100 are not necessary.

Referring now to FIGS. 3–4, line assembly 50 includes line 60 (which may be choke line 61 or kill line 62) having cavity or lumen 67 for permitting fluid to pass through line 60. Line assembly 50 also includes line assembly guide member 64 and line coupling member 70. Line coupling member 70 may be choke line coupling member 71 or kill line coupling member 72 depending on whether a choke line 61 or a kill line 62 is being releaseably connected to line coupling member 70.

Line 60, choke line 61, and kill line 62 preferably include swivel connector 69 to facilitate connection of line assembly 50 to swivel assembly 110 (FIG. 7) to provide easy maneuvering of line assembly 50 for releaseably securing line 60, choke line 61 or kill line 62 to plate assembly 40.

Line assembly guide member 64 may include one or more flanges 66 to facilitate the alignment of line assembly 50 with plate 44 to releaseably connect line 60, choke line 61, or kill line 62 to blowout preventer 38. Alternatively, line assembly guide member 64 may include one or more grooves to facilitate the alignment of line assembly 50 with plate 44 to releaseably connect line 60, choke line 61, or kill line 62 to blowout preventer 38. In the embodiment shown in FIGS. 1–4 and 7–8, flange 66 is adapted to be inserted into groove 49.

Line coupling member 70 and line coupling member 80 may be releaseably secured to each other to form any type of connection known to persons of ordinary skill in the art. For example, line coupling member 70 may be releaseably secured to line coupling member 80 using a clamp, using bolted flanges, using a threaded connection, or using an external locking device, such as a pin, lock lug, or set screw, by which line coupling member 70 is externally connected to line coupling member 80. In a preferred embodiment, line coupling member 70 is releaseably secured to line coupling member 80 to form a breechblock connection 94 (FIGS. 1, 3, 5–7).

While breechblock connections are known by persons skilled in the art, briefly, in ones embodiment, breechblock connection 94 is formed by segmented teeth 95 having teeth valleys 96 therebetween for receiving segmented teeth 95. Segmented teeth 95 may be any shape or size desired or necessary to facilitate releaseably securing line coupling member 70 to line coupling member 80. For example, in one specific embodiment, each of the segmented teeth 95 are rectangularly shaped having 90 degree angled corners and sides. In another specific embodiment, each of the segmented teeth 95 are trapezoidally shaped having corners and sides angled at degrees other than 90 degrees.

In the embodiment shown in FIGS. 1, 3, and 5–7, line coupling member 70 is female coupling member 98 having segmented teeth 95, teeth valleys 96, and breechblock slots 97; and line coupling member 80 is male coupling member 99 having segmented teeth 95 and breechblock slots 97. Line coupling member 80 is inserted into line coupling member 70 by passing segmented teeth 95 disposed along line coupling member 80 through breechblock slots 97 disposed along line coupling member 70; and, thus, passing segmented teeth 95 disposed along line coupling member 70 through breechblock slots 97 disposed along line coupling member 80. After line coupling member 80 is fully inserted into line coupling member 70, line coupling member 80 or line coupling member 70 is rotated such that segmented teeth 95 of line coupling member 70 are disposed within teeth valleys 96 and thus, between segmented teeth 95 of line coupling member 80, and segmented teeth 95 of line coupling member 80 are disposed within teeth valleys 96 and thus, between segmented teeth 95 of line coupling member 70.

A set screw 125 or lock lug 120, 122 disposed along line coupling members 70, 80 may be used to secure line coupling member 70 to line coupling member 80 and to prevent vibrational forces from inadvertently rotating and releasing line coupling member 70 from line coupling member 80.

As mentioned above, line coupling member 70 and line coupling member 80 may be female coupling members 98 or male coupling members 99. As shown in FIGS. 1 and 3, line coupling member 70 is female coupling member 98 and line coupling member 80 is male coupling member 99. It is to be understood, however, that any combination of female coupling members 98 and male coupling members 99 may be utilized in forming the connection between line 60 and blowout preventer 38.

Female coupling member 98 and male coupling member 99 may be any connector system known to persons skilled in the art. For example, the connection of female coupling member 98 with male coupling member 99 may be formed by a use of a clamp, use of bolted flanges, a threaded connection, an external locking device, such as a pin, lock lug, or set screw, by which female coupling member 98 is externally connected to male coupling member 99, or any other device or method known to persons of skilled in the art. However, as shown in FIGS. 1, 3, and 5–7, in a preferred embodiment, the female coupling member 98 and the male coupling member 99 form breechblock connection 94.

Figure 9:
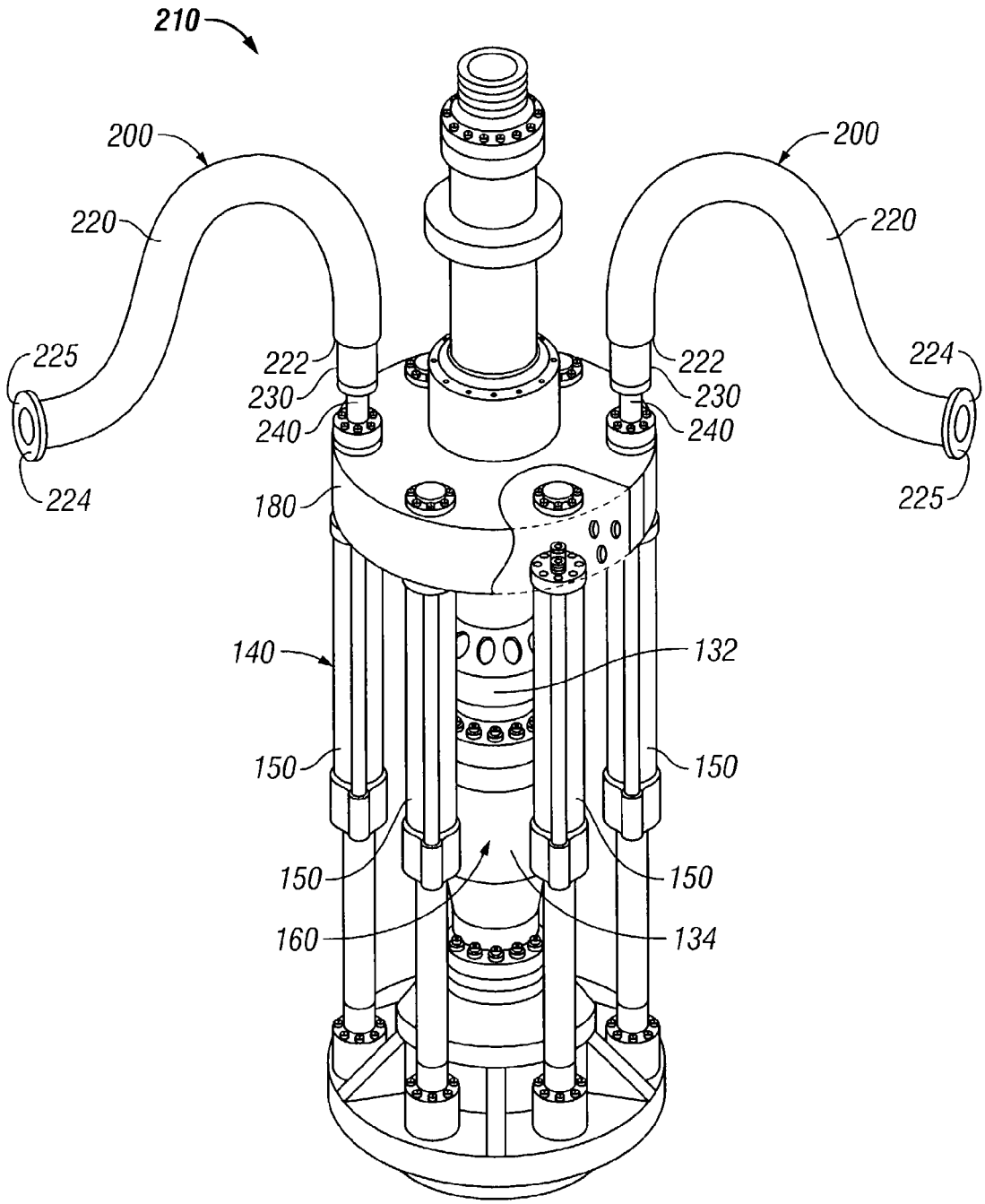
FIG. 9 is a perspective view of a slip-joint tensioner assembly having a specific embodiment of the pressure line system of the present invention.

Referring now to FIG. 9, in another specific embodiment of the invention, pressure lines 200 are used in connection with riser equipment 210. As mentioned above, riser equipment may be a tensioner, a slip-joint assembly, or a slip-joint tensioner assembly, all of which are known in the art. FIG. 9 shows a slip-joint tensioner assembly 120 as disclosed in U.S. Pat. No. 6,530,430, entitled "Tensioner/Slip-Joint Assembly," which is incorporated herein by reference; however, it is to be understood that by removing the inner and outer slip-joint barrels 132, 134, FIG. 9 illustrates a tensioner 140. Additionally, by removing the cylinders 150, FIG. 9 illustrates a slip-joint assembly 160.

While FIG. 9 is directed to one specific tensioner, slip-joint assembly, and slip-joint tensioner, it is to be understood that any riser equipment, or any tensioner, slip-joint assembly, and slip-joint tensioner, may be used in connection with pressure line 200.

Pressure line 200 includes line 220 having first pressure line end 222 and second pressure line end 224. Second pressure line end 224 is adapted to be in fluid communication with a fluid source (not shown) such as air pressure vessels, hydraulic fluid reservoir, drilling mud reservoir, etc., through flange 225 or other similar component readily known by persons skilled in the art for connecting second pressure line end 224 to the fluid source. First pressure line end 222 includes a pressure line coupling member 230 (FIGS. 7 and 9). Riser equipment 210 also includes pressure line coupling member 240 (FIGS. 8 and 9) as a component of the control interface of riser equipment 210 so that riser equipment 210 may be operated. Pressure line coupling member 240 is in fluid communication with the pressure activated components of riser equipment, such as cylinders 150 and slip-joint assembly 160 (inner and outer slip-joint barrels 132, 134) through radial manifold 180.

Figure 8:
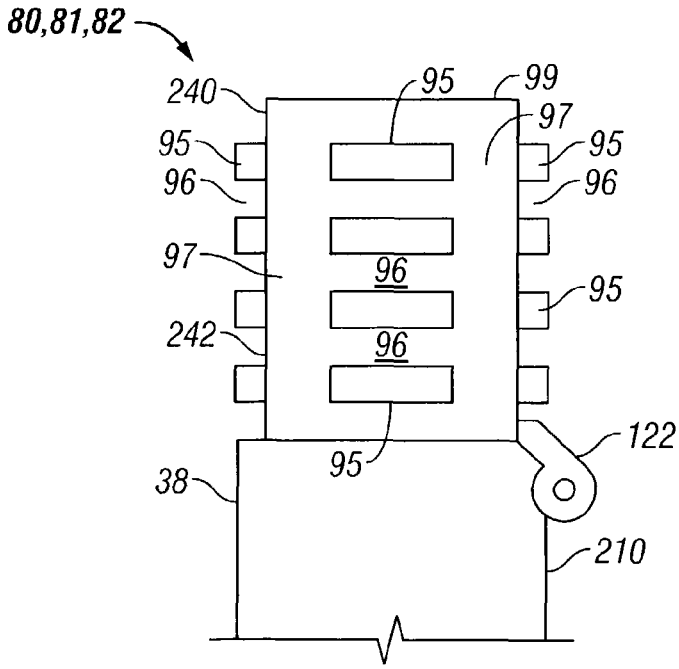
FIG. 8 is a side view of a male line coupling member of one specific embodiment of the present invention.

While pressure line coupling members 230, 240 are shown in FIGS. 7–9 as being female line coupling member 232 and male coupling member 242, respectively, it is to be understood that line coupling member 230 disposed on first pressure line end 222 may be male coupling member 242 or female coupling member 232, and line coupling member 240 disposed on riser equipment 210 may be male coupling member 242 or female coupling member 232, provided that if line coupling member 230 is female coupling member 232, then line coupling member 240 must be male coupling member 242 (as shown in FIGS. 7–8); and if line coupling member 230 is male coupling member 242, then line coupling member 240 must be female coupling member 232.

In the preferred embodiment, line coupling member 230 and line coupling member 240 releaseably connect to form a breechblock connection 94 as discussed above with respect to coupling system 30 and choke and kill line system 32 (FIGS. 1–8).

While it is contemplated that the pressure lines, e.g., choke lines, kill lines, and riser equipment pressure lines, may have any diameter, and withstand any pressure, desired or necessary to supply pressure to the BOP stack or riser equipment without rupturing the pressure lines, it has been discovered that coupling system 30, choke and kill line system 32, and pressure line system 200 (FIGS. 7–9) work well in connection with choke line 70, kill line 80, and pressure line 202 (FIG. 9) having diameters greater than 2 inches and capable of withstanding 10,000 psi.

It is to be understood that the invention is not limited to the exact details of construction, operation, exact materials, or embodiments shown and described, as obvious modifications and equivalents will be apparent to one skilled in the art. For example, the line assembly may be connected to the plate assembly by including a pin, bolt or other external device to secure the line assembly guide to the plate assembly guide. Additionally, as mentioned above, the plate guide member and line guide assembly member may be any shape desired or necessary to align plate assembly with line assembly. For example, the plate guide member may include a groove and the line assembly guide member may include one or more flanges adapted for insertion into the groove. Alternatively, the line assembly guide member may include a groove the plate guide member may include one or more flanges adapted for insertion into the groove. Moreover, the plate may be formed integral with the line coupling member and/or the blowout preventer coupling member; the line coupling member may be connected directly to the blowout preventer; the line coupling member may be connected directly to the blowout preventer coupling member; or the line assembly may not include a line assembly guide member. Accordingly, the invention is therefore to be limited only by the scope of the appended claims.

What is claimed:

1. A choke and kill line system for a blowout preventer comprising:

a choke line having a choke line coupling member for connecting the choke line to the blowout preventer;

a kill line having a kill line coupling member for connecting the kill line to the blowout preventer;

a first line coupling member secured to the blowout preventer, the first line coupling member being adapted for releaseably connecting the first line coupling member to the choke line coupling member, and the choke line coupling member being adapted for releaseably connecting the choke line coupling member to the first line coupling member; and a second line coupling member secured to the blowout preventer, the second line coupling member being adapted for releaseably connecting the second line coupling member to the kill line coupling member, and the kill line coupling member being adapted for releaseably connecting the kill line coupling member to the second line coupling member, wherein the choke line coupling member and the first line coupling member releaseably connect to form a breechblock connection; and the kill line coupling member and the second line coupling member releaseably connect to form a breechblock connection.

2. The choke and kill line system of claim 1, wherein:

the choke line coupling member is a male coupling member and the first line coupling member is a female coupling member; and the kill line coupling member is a male coupling member and the second line coupling member is a female coupling member.

3. The choke and kill line system of claim 1, wherein:

the choke line coupling member is a female coupling member and the first line coupling member is a male coupling member; and the kill line coupling member is a female coupling member and the second line coupling member is a male coupling member.

4. The choke and kill line system of claim 1, wherein:

the choke line coupling member is a male coupling member and the first line coupling member is a female coupling member; and the kill line coupling member is a female coupling member and the second line coupling member is a male coupling member.

5. The choke and kill line system of claim 1, wherein:

the choke line coupling member is a female coupling member and the first line coupling member is a male coupling member; and the kill line coupling member is a male coupling member and the second line coupling member is a female coupling member.

6. A choke and kill line system for a blowout preventer comprising:

at least one choke line coupling member, at least one of the at least one choke line coupling members having first and second choke line ends, the first choke line end being adapted to be releaseably connected to a choke line and the second choke line end being adapted to be in fluid communication with the blowout preventer; and at least one kill line coupling member, at least one of the at least one kill line coupling members having first and second kill line ends, the first kill line end being adapted to be releaseably connected to a kill line and the second kill line end being adapted to be in fluid communication with the blowout preventer, wherein the first choke line end is adapted to form a breechblock connection with the choke line and the first kill line end is adapted to form a breechblock connection with the kill line.

7. A coupling system for releaseably connecting a line to a blowout preventer comprising:

a plate having a plate guide member, a first line coupling member, and a blowout preventer connector member in fluid communication with the first line coupling member and in fluid communication with the blowout preventer; and a line assembly having a line, a line assembly guide member, and a second line coupling member, wherein the first line coupling member and the second line coupling member are each adapted to be releaseably connected with each other to form a breechblock connection.

8. The coupling system of claim 7, wherein the first line coupling member is a female coupling member and the second line coupling member is a male coupling member.

9. The coupling system of claim 7, wherein the first line coupling member is a male coupling member and the second line coupling member is a female coupling member.

10. The coupling system of claim 7, wherein the line assembly guide member includes at least one flange and the plate guide member includes at least one groove adapted for receiving the at least one flange.

11. The coupling system of claim 7, wherein the plate guide member includes at least one flange and the line assembly guide member includes at least one groove adapted for receiving the at least one flange.

12. The coupling system of claim 7, wherein the plate, the first line coupling member, and the blowout preventer connector member are formed integrally with each other.

13. A coupling system for releaseably connecting a choke line and a kill line to a blowout preventer, the coupling system comprising:

a choke line coupling member, the choke line coupling member having first and second choke line ends, the first choke line end being adapted to be releaseably connected to a choke line and the second choke line end being adapted to be in fluid communication with the blowout preventer, wherein, the first choke line end is adapted to form a breechblock connection with the choke line; and a kill line coupling member, the kill line coupling member having first and second kill line ends, the first kill line end being adapted to be releaseably connected to a kill line and the second kill line end being adapted to be in fluid communication with the blowout preventer, wherein the first kill line end is adapted to form a breechblock connection with the kill line.

14. The coupling system of claim 13, wherein the first choke line end is a male coupling member and the first kill line end is a male coupling member.

15. The coupling system of claim 13, wherein the first choke line end is a female coupling member and the first kill line end is a female coupling member.

16. The coupling system of claim 13, wherein the first choke line end is a female coupling member and the first kill line end is a male coupling member.

17. The coupling system of claim 13, wherein the first choke line end is a male coupling member and the first kill line end is a female coupling member.

18. A pressure line system for a tensioner comprising:

at least one pressure line coupling member, at least one of the at least one pressure line coupling members having first and second pressure line ends, the first pressure line end being adapted to be releaseably connected to a pressure line and the second pressure line end being adapted to be in fluid communication with the tensioner, wherein the first pressure line end is adapted to form a breechblock connection with the pressure line.

19. A pressure line system for a slip-joint assembly comprising:

at least one pressure line coupling member, at least one of the at least one pressure line coupling members having first and second pressure line ends, the first pressure line end being adapted to be releaseably connected to a pressure line and the second pressure line end being adapted to be in fluid communication with the slip-joint assembly, wherein the first pressure line end is adapted to form a breechblock connection with the pressure line.

20. A pressure line system for a slip-joint tensioner assembly comprising:

at least one pressure line coupling member, at least one of the at least one pressure line coupling members having first and second pressure line ends, the first pressure line end being adapted to be releaseably connected to a pressure line and the second pressure line end being adapted to be in fluid communication with the slip-joint tensioner assembly, wherein the first pressure line end is adapted to form a breechblock connection with the pressure line.

21. A pressure line system for a tensioner comprising:

a pressure line having a first pressure line end and a second pressure line end, the first pressure line end having a first breechblock coupling member and the second pressure end being adapted to be in fluid communication with a pressure source; and a second breechblock coupling member in fluid communication with the tensioner, wherein, the first breechblock coupling member is releaseably connected to the second breechblock coupling member to form a breechblock connection between the pressure line and the tensioner.

22. A pressure line system for a slip-joint assembly comprising:

a pressure line having a first pressure line end and a second pressure line end, the first pressure line end having a first breechblock coupling member and the second pressure end being adapted to be in fluid communication with a pressure source; and a second breechblock coupling member in fluid communication with the slip-joint assembly, wherein, the first breechblock coupling member is releaseably connected to the second breechblock coupling member to form a breechblock connection between the pressure line and the slip-joint assembly.

23. A pressure line system for a slip-joint tensioner assembly comprising:

a pressure line having a first pressure line end and a second pressure line end, the first pressure line end having a first breechblock coupling member and the second pressure end being adapted to be in fluid communication with a pressure source; and a second breechblock coupling member in fluid communication with the slip-joint tensioner assembly, wherein, the first breechblock coupling member is releaseably connected to the second breechblock coupling member to form a breechblock connection between the pressure line and the slip-joint tensioner assembly.

24. The pressure line system of claim 23, wherein the first breechblock coupling member is a male breechblock coupling member and the second breechblock coupling member is a female breechblock coupling member.

25. The pressure line system of claim 23, wherein the first breechblock coupling member is a female breechblock coupling member and the second breechblock coupling member is a male breechblock coupling member.

26. The pressure line system of claim 23, wherein the pressure line includes a diameter greater than two inches.

* * * * *